United States Patent [19]

Macabee

[11] 4,139,001

[45] Feb. 13, 1979

[54] HYDRO-MASSAGE AND PULSATOR APPARATUS

[76] Inventor: Lloyd C. Macabee, 552 Bean Creek Rd., No. 41, Scotts Valley, Calif. 95060

[21] Appl. No.: 730,987

[22] Filed: Oct. 8, 1976

[51] Int. Cl.[2] ..... A61H 7/00; A61H 9/00

[52] U.S. Cl. ..... 128/64; 128/66

[58] Field of Search ..... 128/64–66, 128/24.1, 365, 366

[56] References Cited

U.S. PATENT DOCUMENTS

| | | | |
|---|---|---|---|
| 2,250,878 | 7/1941 | Quaranti | 128/66 UX |
| 2,905,171 | 9/1959 | De Crescenzo | 128/66 X |
| 3,720,204 | 3/1973 | Wojtowicz | 128/64 |

FOREIGN PATENT DOCUMENTS

| | | | |
|---|---|---|---|
| 46009 | 2/1889 | Fed. Rep. of Germany | 128/66 |
| 457964 | 7/1913 | France | 128/64 |
| 283015 | 1/1965 | Netherlands | 128/66 |

*Primary Examiner*—Lawrence W. Trapp
*Attorney, Agent, or Firm*—Michael L. Harrison

[57] ABSTRACT

A flexible mat having a plurality of protruding members and a plurality of apertures is agitated by pressure pulsation in a stream of highly turbulent mixture of water/air which is applied to the back surface of the mat. As pressure pulses swell and subside in alternation, the protruding members are caused to manipulate the user's body producing a stimulating, therapeutic massage effect. Simultaneously, the water/air mixture is forced through the apertures of the mat producing a turbulent bath having a high proportion of air bubble content which further manipulates and massages the user's body. A pulsator mechanism, particularly adapted for use with the flexible mat, is comprised of a cylindrical housing in which a centrally mounted shaft driven by a paddle-wheel type impeller turns a rotor cylinder causing apertures in the rotor cylinder to align and misalign in alternation with a matching hole pattern on an adjacent fixed plate, thereby causing, in rapid alternation, interruption and reinstatement of water flow to produce tbhe pulsation of pressure which is required to agitate the flexible mat. An air inlet in the vicinity of the rotor cylinder and fixed plate allows air to be entrapped in the water, thereby producing the water/air mixture. Deliberately induced mechanical vibration of the pulsator is transmitted directly to the enclosure which supports the flexible mat thereby further enhancing the desired massage effect.

14 Claims, 14 Drawing Figures

HYDRO-MASSAGE AND PULSATOR APPARATUS

BACKGROUND OF THE INVENTION

1. Field of the Invention

The present invention relates to hydro-therapy apparatus and in particular to hydro-massage apparatus employing a combination of water and air in pulsation to manipulate a flexible massage mat, the manipulations of which are applied to the body of the user.

2. The Prior Art

Massage of muscle tissues is generally thought to produce dilation of blood vessels with attendant increase in blood circulation and enhancement of discharge of waste from the muscle tissues. Muscular pain and tension are alleviated leaving the subject relaxed and revitalized.

While many forms of massage are available, a favorite of some users is a circulating hydro-therapy bath, sometimes called a whirlpool bath, wherein a mixture of water and air is circulated at fairly high velocity in a bathtub or the like. Examples of such a bath are found in many patents, notably those of Jacuzzi of which U.S. Pat. No. 3,297,025 is a typical one.

Another frequently used hydro-therapy bath employs a source of compressed air which is connected to a manifold adapted to be placed at the bottom of a bathtub or the like. The manifold discharges air through its ports causing bubbles to form and agitating the bath by means of the bubbles rising to the top of the bath due to their natural buoyancy. Examples of the use of this type of bath, and equipment for producing compressed air and discharging the compressed air into the water are found in many patents, of which Rico, et al., U.S. Pat. No. 3,710,786, Vaughan U.S. Pat. No. 3,750,656, Baumann U.S. Pat. No. 3,809,073 and Klages U.S. Pat. No. 3,870,040 are typical examples, among many others.

The motive force in all of the above examples is the force of moving water, whether produced by pumping the water or by agitating it by compressed air means. The massage effect produced appears to be satisfying to many users, but lacks the vigor of manipulation that direct contact of the user's body by highly flexibly but relatively firm objects can provide.

To obtain the vigorous stimulating massage which is desired by many and which approximates the massage which can be given by a skilled masseur or masseuse, it is necessary to go beyond the teachings of the prior art and to devise an apparatus which, in the context of a hydro-therapy bath, can produce the necessary direct manipulation by a highly flexible but firm object. In combination with the existing comparatively mild effect of hydrotherapy baths, the new device would provide a complete body massage, simultaneously giving especially vigorous massage to selected parts of the body, in particular the large muscles of the back, and exposing the user to the additional therapy of a warm and stimulating bath.

SUMMARY OF THE PRESENT INVENTION

It is an object of the present invention to provide a new massage apparatus useful in bathtub enclosures or the like.

It is another object of the present invention to provide a new massage apparatus which is hand-held.

It is still another object of the present invention to provide a new massage apparatus which is activated by pulsating water flow.

It is yet another object of the present invention to provide a new apparatus for creating fluid pulsations.

It is yet still another object of the present invention to provide a new apparatus for entrapping air in a pulsating water flow.

It is still another object of the present invention to provide a new combination of a massage apparatus and a turbulence and air-entraining device for producing a combination hydrotherapeutic bath and mechanical massage.

It is even yet another object of the present invention to provide a combination of a massage apparatus and a fluid pulsator which cooperates by means of the fluid pulsation being applied to massage apparatus.

It is yet still another object of the present invention to provide a fluid pulsator apparatus having deliberately induced high amplitude mechanical vibrations which are in synchronism with the pulsations of the fluid.

Briefly, the present invention accomplishes these and other objects by providing a large, flexible mat having a plurality of individual members adapted to move in response to the urging of a pulsating stream of water or mixture of water and air, and a vibrator mechanism for creating pulsations of water, or water and air, and for transmitting mechanical vibrations directly to the flexible mat, whereby a user, by placing a part of his or her body in contact with the mat receives a mechanical manipulation by the plurality of members attached to the mat, and, in addition, receives the gentler stimulation of the agitated water bath provided by the water pulsation and the mixture of the water with a high percentage of air.

The operation of the present invention may best be understood by referring to the drawings, wherein:

BRIEF DESCRIPTION OF THE DRAWINGS

FIG. 1 is a cross-sectional view of the present invention showing installation in a bathtub enclosure or the like.

DESCRIPTION OF THE PREFERRED EMBODIMENT

1. General Description.

Figure 1:
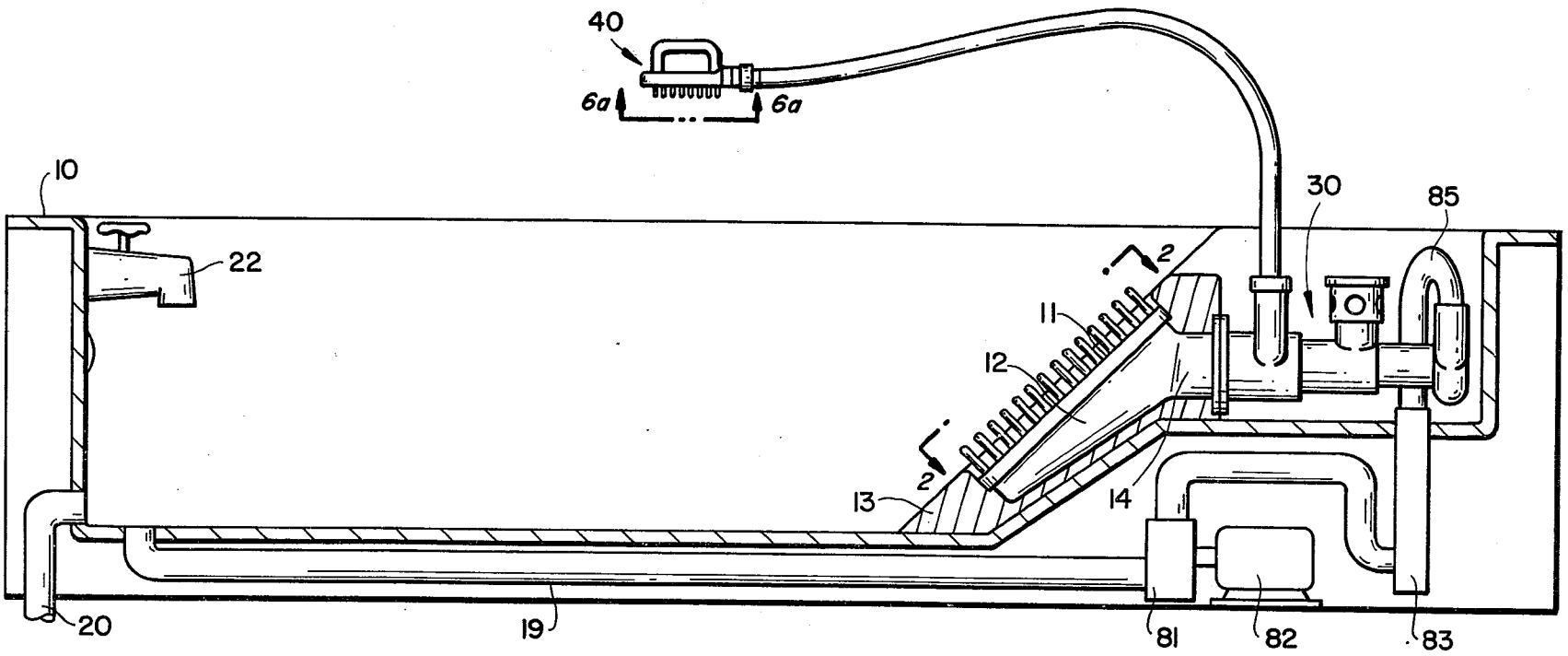

A preferred embodiment of the present invention is shown generally in FIG. 1, wherein the present invention is installed in the usual bathtub enclosure or the like for use in an individual private bath. The broad aspects of the present invention may be readily appreciated by referring to FIG. 1 in conjunction with the following paragraphs.

The preferred mode of carrying out the present invention is the installation of the massager and cooperating vibrator within the confines of a special bathtub enclosure or the like in which adaptation is made for mounting the flexible massage mat 11 and its backing enclosure 12. A compact and attractive installation may be accomplished by mounting the pump 81, and pump motor 32 along with the water heater 83, under the surface of the tub enclosure 10. It will generally be preferred to provide the bathtub enclosure or the like with the usual plumbing fixtures 22. In addition, it is desirable to either include a two-way valve, which allows water within the tube to be either recirculated through a return line 19 or drained into the normal drainage system through exhaust line 20, or to provide a separate inlet for the suction line from the pump 81.

In oepration, the bathtub is first filled to any desired height, but in general a height sufficient to cover the highest apertures in the flexible mat 11. The recirculation pump motor 82 is then energized and begins to drive the recirculation pump 81, causing water within the bathtub to pass through the return line 19 under the urging of gravity and the pump's suction, and to enter the water heater assembly 83.

During passage through the water heater assembly 83, an increment of heat energy is added to the water. Incremental additions of heat energy and, consequently, incremental increases in temperature are added to the recirculating water upon each complete recirculation until the desired maximum temperature is reached, at which time the temperature rise is stopped and then maintained by thermostatic control.

The output of the water heater assembly 83 feeds directly through a flexible hose 85 into the inlet port of the pulsator 30. The pulsator 30 converts the continuous stream of water from the pump 81 into a pulsating stream, while at the same time mixing a large volume of air into the stream of water and agitating and vibrating the mixture.

From the output of the pulsator 30, the stream of pulsating water/air mixture flows into the inlet port 14 of the backing enclosure 12 and through the apertures 16 of the flexible mat 11. A user of the embodiment described places his back or side against the flexible mat 11 and is thereby subjected to minute but firm manipulation of that portion of the body due to the action of the flexible mat 11. At the same time, the more subtle hydro-therapeutic massage which results from agitation of the water bath by air entrapment and pulsation is also present.

2. Massage Apparatus (Stationary).

The above paragraphs have described in broad concept the operation of the present invention. The structure of each of the constitutent parts is explained in detail in the succeeding paragraphs.

Figure 2:
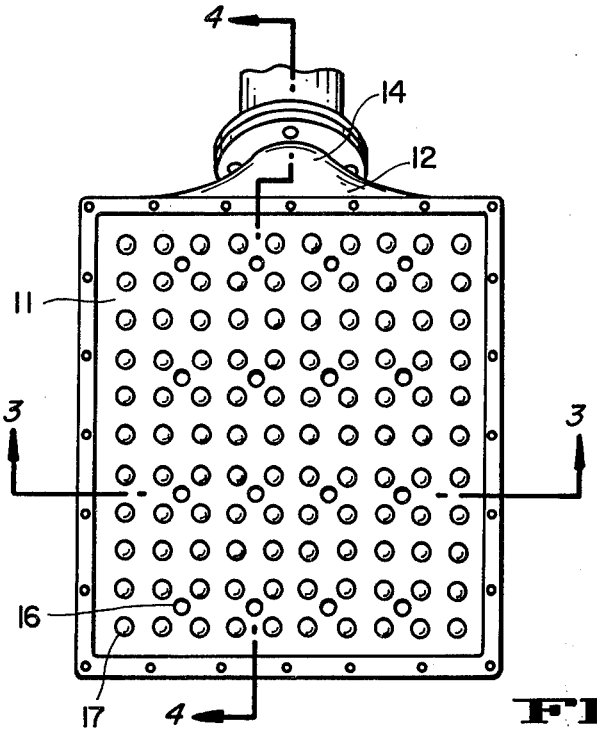
FIG. 2 is a detail frontal view of the large flexible mat and backing enclosure.
Figure 3:
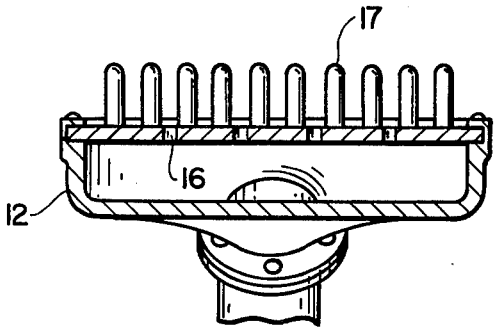
FIG. 3 is a detail cross-sectional view of the flexible mat and backing enclosure taken through section line 3—3.
Figure 4:
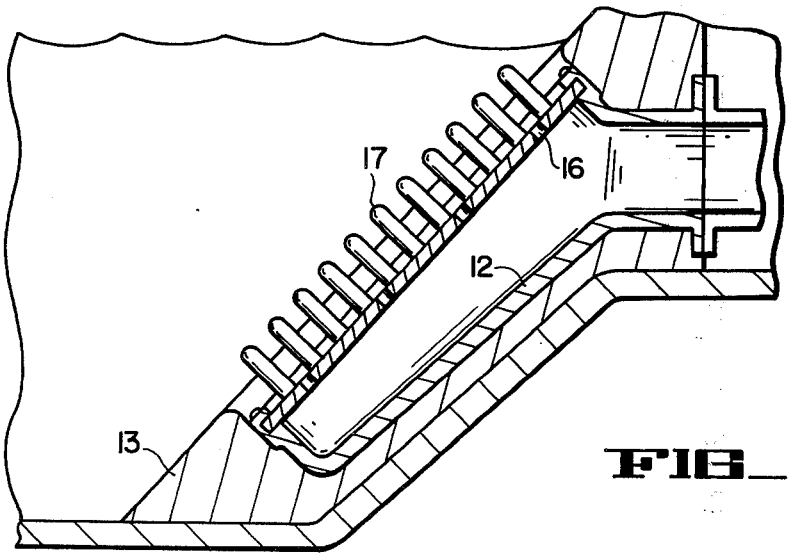
FIG. 4 is a detail cross-sectional view of the flexible mat and backing enclosure taken through section line 4—4.

Referring now to FIG. 2, there is shown therein a frontal view of the flexible mat 11. Attached to the mat and partially visible is the backing enclosure 12 with inlet port 14. A cross-sectional view through section line 3—3 is shown in FIG. 3, and a cross-sectional view through section line 4—4 is shown in FIG. 4. The general outline of the mat 11 and enclosure 12 may be seen by referring simultaneously to FIGS. 2, 3 and 4.

The entire frontal surface of the mat 11, except those portions along the edge which are used as anchor points to secure the mat to the edges of the backing enclosure 12, is covered with protruding members 17, hereinafter also referred to as "fingers" 17. At intervals spread over the area of the mat, apertures 16 are provided. The spacing of the fingers 17 and apertures 16 may be somewhat arbitrary and irregular, but it will be preferred, for convenience of manufacture and predictability of performance, to follow the practice of regularly spacing both the fingers 17 and the apertures 16. In the mat depicted, the fingers 17 and apertures 16 are arrayed on a regular matrix having rank and file line spacings of $\frac{5}{8}$ inch. Apertures 16 are spaced at every fourth line of rank and file. The fingers 17 depicted are approximately $1\frac{1}{2}$ inches in length.

In carrying out the design of the present invention, it will be desirable to select the size of the apertures 16 for providing a moderate amount of resistance, in the aggregate, to the flow of water supplied to the inlet 14 of the enclosure 12. Apertures 16 of smaller than desired size will produce fairly constant distensions of the mat 11, while apertures 16 of too great a size will not respond to the pressure impulses produced by the pulsator and, accordingly, will produce little massage effect.

The design of the backing enclosure 12 is non-critical providing only that that enclosure must have sufficiently large dimensions in every plane so that the flow resistance offered by the enclosure is low in comparison to the flow resistance offered by the apertures 16 of the flexible mat 11. Providing that this requirement is met, the instantaneous pressure impulses will be relatively uniformly distributed over the entire back surface of the mat 11 and will cause, in turn, the massage effect to be produced uniformly over the area of the user's body in contact with the mat 11.

The enclosure 12 is preferable fabricated of a semi-rigid substance such as hard rubber in order to achieve maximum transmission of vibrations through the enclosure 12 to the mat 11 as is described below.

It will be desirable in carrying out the design of the present invention to fabricate the flexible mat 11 from material which is not only flexible but is, preferably, at least slightly elastic. A number of rubber compounds and plastic compounds are suitable to meet this criterion and many of those classes of compounds also exhibit the necessary strength and durability characteristics required for a commercially acceptable design. A prototype mat fabricated of Neoprene rubber appears to offer a nearly ideal mixture of desired characteristics, namely, extreme durability and flexibility, easy moldability, slight elasticity in the thickness employed, and low material cost. The fingers 17 and apertures 16 may be molded into a mat made of this material in a single process. Its ability to withstand the bursts of pressure required to produce the desired massage effect also appears to be excellent.

As described briefly above, the massage effect is produced by the action of the pulsating stream of water/air mixture operating on the back surface of the mat 11. This effect is heightened by the simultaneous agitation of the bath by way of air entrapment, and ejection of the water/air mixture from the apertures 16 of the mat 11. The action of the mat 11 in response to impulses of pressure due to bursts of the water/air mixture is described below.

Figure 5A:
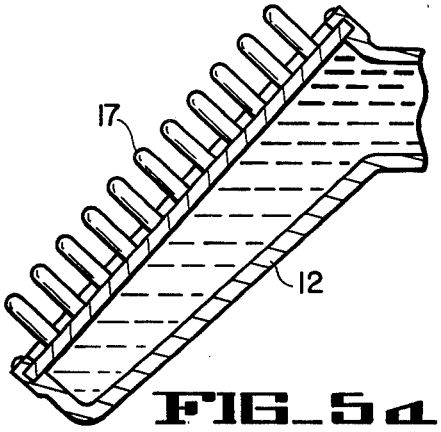
FIG. 5 shows three views of the flexible mat at various times during a pulse of water/air mixture.
Figure 5B:
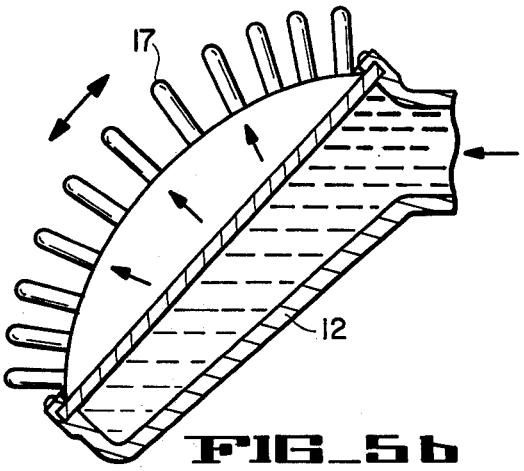
Figure 5C:
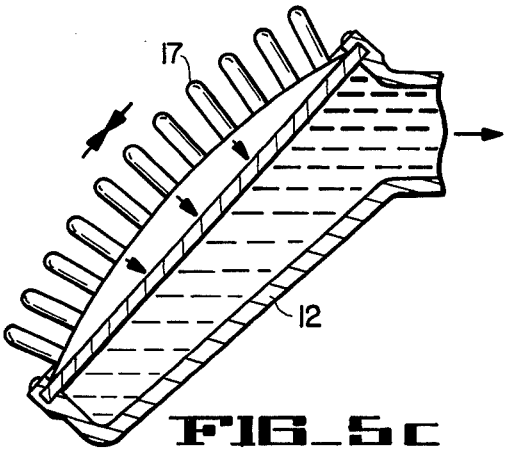

Referring now to FIG. 5, there are shown in the figure three views of the flexible mat 11 described above. In FIG. 5(*a*), a mat 11 at rest is depicted, representative of the state in which no pumping action is taking place. In FIG. 5(*b*) there is shown a mat which is being subjected to a burst of water/air mixture from the output of the pulsator 30. The curvature of the mat 11 is exaggerated to show the motion of the fingers 17. As the mat 11 is urged outward, the mat assumes a convex shape causing the fingers 17 to be thrust into the surface of the user's body. Simultaneously the tips of these fingers are urged away from one another as they attempt to remain perpendicular to the surface of the mat 11. As the pressure impulse subsides, the mat 11 relaxes toward its original position causing the fingers 17 to be urged toward one another as they attempt to remain perpendicular to the mat 11, as shown in FIG. 5(*c*).

The action of the mat 11 generally follows that described above, but it will be readily appreciated by those skilled in the art of hydraulics, that instantaneous transmittal to the back surface of the mat of uniform pressure front will not result, in view of the highly turbulent flow produced by the apparatus described herein. At points along the back of the mat, therefore, there will be higher and lower pressure points.

This effect will produce irregular distension of the mat 11 although the general contours of the mat 11 will be as depicted in FIG. 5. However, this effect is not only non-detrimental, it is also highly desirable. The forces experienced by the user because of the highly turbulent flow and the irregular distension of the mat 11 will be all the more vigorous since the peaks and troughs of the amplitude at any given point on the mat 11 will tend to have a higher amplitude than the peaks and troughs of a mat responding to uniform, non-turbulent pressure impulses. Thus, a more vigorous massage is affected both due to higher contact forces and larger amplitude separations among the fingers 17.

Adaptation of the edges of the opening in the enclosure 12 to receive and attach to the edges of the mat 11 is illustrated in FIGS. 2 and 3. While a screw fastening system is depicted, it will be appreciated that any mechanically secure system which can produce a relatively water tight seal will be useable.

Referring again now to FIGS. 1 and 2, there is shown in the figures an important detail of the method of mounting the enclosure 12 within the bathtub. A resilient medium 13 surrounds the enclosure and its inlet port 14. At no point is the enclosure allowed to contact another rigid body except for the contact made with the outlet flange of the pulsator 30. Thereby, the enclosure is left free to vibrate in response to the vibrations produced by the pulsator 30 which are transmitted directly to the inlet flange of the enclosure 12. Mechanical vibration is deliberately enhanced within the pulsator 30 in order to enhance the effect of directly transmitted vibration at the fingers 17 of the mat 11. Thus, even in the absence of water flow, a massage effect, albeit a less vigorous one, is produced at the mat 11. Deliberate inducement of vibrations is obtained by eccentric weighting of the pulsator's venturi rotor and impeller as will be described below.

3. Massage Apparatus (Hand-held).

Figure 6A:
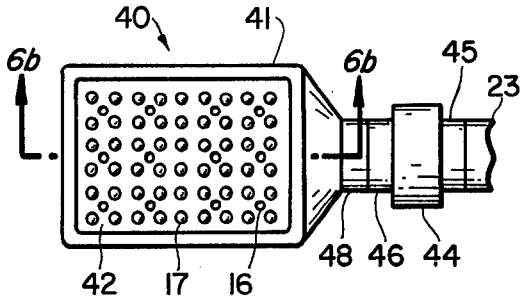
FIG. 6 shows two orthogonal views of a hand-held massage apparatus in accordance with the present invention.
Figure 6B:
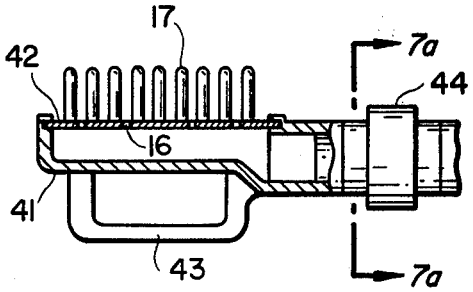

Referring now to FIG. 6, there is shown a hand-held massage apparatus employing the same principle of operation described above regarding the energization of the flexible mat 11 by a turbulent water/air mixture. In the figure, the hand-held massage apparatus comprises a rigid housing 41 which also serves the same function as the backing enclosure 12 described above. A handle 43 is preferably molded onto the housing to allow convenient manuevering of the apparatus. A flexible mat 42 has fingers 17 and apertures 16 as described for the larger flexible mat 11 above, but is rendered in smaller scale. At the inlet port 48 to the housing 41, there is located an impeller housing 44 to which is attached a coupling 46 adapted to mate with the inlet port 48, and a coupling 45 adapted to mate with a flexible hose 23. The entire assembly including the flexible hose is shown in FIG. 1.

Pulsating water/air mixture is obtained from an auxiliary port on the pulsator assembly 30 and is supplied to the hand-held apparatus 40 through the flexible hose 23.

Since the hand-held apparatus is located at the end of a flexible hose, direct transmission of vibrations from the pulsator 30 is not possible, unlike the case of the larger flexible mat 11. Since it is nonetheless desirable to provide such vibrations, an auxiliary vibrator is provided at the inlet 48 to the housing 41. An eccentrically weighted impeller 47 turns under force of the stream of water/air mixture causing a vigorous mechanical vibration localized near the housing 41. A strong massage effect is thereby produced, similar to that obtained for the larger mat.

Figure 7A:
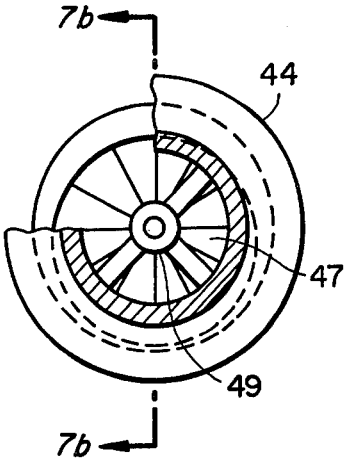
FIG. 7 shows two orthogonal views of the impeller housing portion of the hand-held massage apparatus.
Figure 7B:
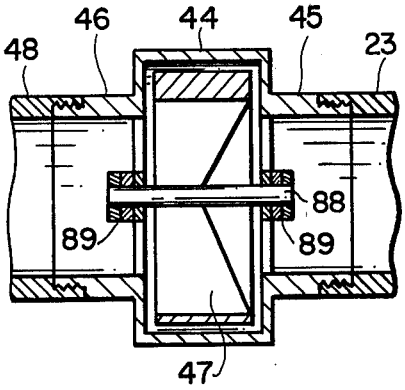

Rotation of the impeller 47 is preferably made about a centrally located shaft 88, turning in water bearings 89 affixed to the impeller housing 44 as shown in FIG. 7.

4. Pulsator

Figure 8:
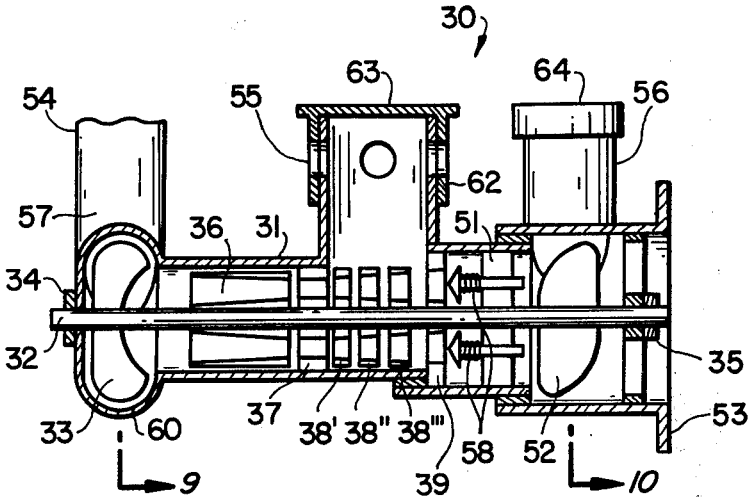
FIG. 8 is a cross-sectional view of a pulsator apparatus in accordance with the present invention.

Referring now to FIG. 8, there is shown a novel pulsator apparatus 30 which is designed to produce the desired turbulent, water/air mixture which is required to activate the large flexible mat 11 and the hand-held massage apparatus 40, both of which have been described previously. The following paragraphs describe the pulsator 30 operation and its novel features with particular emphasis given to the cooperation between the pulsator and the massage apparatus.

In cross-section, the pulsator 30 shown in FIG. 8 is seen to comprise an elongated housing 31 in which is contained a rotating shaft 32, suspended at either end by water bearings 34 and 35, upon which are mounted, from left to right in the figure, a drive impeller 33, a rotating cylinder 36 and a suction fan 52. Along the exterior of the housing, again from left to right in the figure, are located an inlet port 54, an air inlet assembly 55 and an auxiliary outlet port 56.

At the inlet side of the housing 31, the inlet port 54 communicates with an inlet passageway 57 which becomes the inlet portion of a reversed pump volute 60. The contours of the housing are adapted to serve as the volute without requiring separate manufacture of a volute assembly. Inside the volute, a paddle type impeller 33 is affixed to the rotating shaft 32.

Water entering the inlet port 54 under pressure from the pump 81, flows into the volute 60 through passageway 57. Upon entering the volute, the water stream strikes the paddles of the runner 33 thereby imparting a turning moment to the shaft 32 and causing it to rotate. When a steady-state condition is attained, the shaft rotation speed is a function of the volume per unit time of water which flows into the volute.

Water exits the volute in a direction parallel to the rotating shaft 32 and enters the main part of the housing 31. At this point, the housing is preferably approximately 3 inches in diameter although other dimensions appropriate for different purposes may also be employed if other parts of the assembly are scaled proportionally.

Water then enters the rotating cylinder 36 which, being affixed to the same shaft as the runner 33 rotates in synchronism with it. Within the rotating cylinder 36 are located a plurality of apertures in approximate alignment with the shaft 32. The apertures are preferably rendered in inverted conical form so as to form the input side of a venturi tube. For the applications being discussed, an appropriate size for the cylinder is approximately 2⅞ inches diameter by 2½ inches length. The negative conical flare for this size cylinder may be from approximately 1 inch on the input side to ⅝ inch at the output side. The conical orifices, which may vary in size from the dimensions described, and which may also be of varying size within a particular rotating cylinder design, should preferably be evenly spaced around the cylinder.

Adjacent to the rotating cylinder is located a fixed plate 37 having apertures designed to correspond to the output side aperture pattern of the rotating cylinder 36.

As the cylinder 36 rotates, the apertures of the cylinder repetitively align and then misalign with the apertures of the fixed plate 37. At each alignment, the flow of water continues through the cylinder 36 and plates 37. At each misalignment, the water flow is interrupted. Thus, a series of rapid interruptions and reinstatements of water flow is accomplished. With each alignment, a burst of water passes through the rotating cylinder 36 and the fixed plate 37 and continues along the direction of the shaft axis, left to right in FIG. 7, until the burst passes through a series of venturi plates 38', 38'', 38''', etc. Each plate is spaced apart from the next so that packets of air which fill the voids in the plates during the absence of water bursts are rammed ahead of the water bursts when flow is reinstated by alignment between cylinder 36 and fixed plate 37.

The venturi plates 38 are preferably designed so that each plate when considered in relationship to the next, and all of which when considered in relationship to fixed plate 37, provide a continuous pattern of aperture flares so that a virtual surface formed by aligning the surface with the individual aperture side walls, forms a classic venturi tube output portion.

The venturi effect achieved by the structure above described provides two distinct functions. First, the water velocity is increased prior to entering the output stage of the venturi thus preventing loss of overall velocity as the bursts of water entrap packets of air in the output section of the venturi. Second, due to the flow of water through the output series of plates 38', 38'', 38''', etc., a suction is created around the plates in the air inlet assembly 55 thereby causing fresh air from the exterior of the housing 31 to enter the air inlet assembly 55 and to fill the voids between the venturi plates and within their apertures. The next burst of water exiting the apertures of plate 37 therefore finds a fresh packet of air available for entrapment in the water stream.

At the last venturi plate 39, there are located flutter check valve assemblies 58, mounted on bracket 51 for producing water agitation and preventing backflow of water from the output portion of the housing into the input portion. A light restorative force maintains the valves closed unless the forward movement of the water/air mixture overcomes the restorative force, causing the valve to flutter open and closed.

A gradual, or, as shown, a step increase in the diameter of the housing 31 is desirable at some point along the length of the venturi flare to provide for the expanded volume of the water/air mixture. Thus, excessive compression of the air within the housing, which would have the effect of lowering the efficiency of air entrainment because of excessive back pressure in the output portion of the housing, is avoided.

Figure 10:
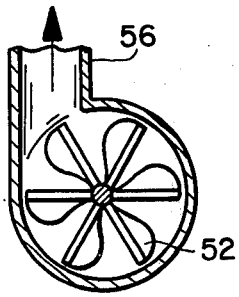
FIG. 10 is a view, along the axis of the rotor shaft, of the suction fan.

Continuous positive flow is maintained, and further agitation of the water/air mixture is provided by a suction fan 52 turning on the rotating shaft 32. The fan 52 clears water/air mixture from the output section of the housing and propels the mixture into the backing enclosure 12. A frontal view of the suction fan 52 is shown in FIG. 10.

Figure 9:
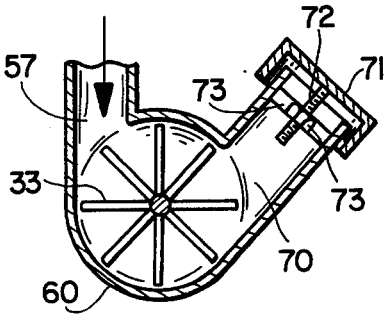
FIG. 9 is a view, along the axis of the rotor shaft, of the runner of the pump volute.

Referring now to FIG. 9, there is shown an important detail of the inlet 57 and reversed pump volute 60 portion of the pulsator 30. As water enters through inlet port 57, the paddle type runner 33 turns under the force of the inrushing water which then exits through the opening into the pulsator housing 31. It will be appreciated, upon consideration of the basic operation of the pulsator, that a condition may arise in which the rotor cylinder 36 and the first venturi plate 37 are misaligned at the outset. If this condition occurs with water standing in the pulsator housing, no further water flow will be available to produce rotation of the rotor cylinder 36. Then no flow through the output of the pulsator will take place.

This problem may be solved by providing for bypass of a portion of the water around the pulsator, but through the reversed volute 60. This is accomplished in the preferred embodiment by providing an output port 70 through which water can flow without regard for the alignment or misalignment of the rotor cylinder 36. Thus, water may enter through inlet port 57 and produce a rotation as it passes around the volute before exiting through outlet port 70. It may be seen, therefore, that no stall condition can result.

The amount of water allowed to bypass the volute may be regulated by adjustment of a cap 71 located at the output port 70. By means of an exterior threaded rod 72 engaging an internally threaded nut 73, adjustment from fully closed to, essentially, fully open may be accomplished.

From the standpoint of overall design and performance the pulsator described above is an efficient solution to the problem of providing highly maximum pulsation of the water/air mixture. Primarily, pulsation is achieved by the rapid interruption and reinstatement of water flow and the interspersing of large packets or air in the stream. The performance thereby achieved ideally cooperates with the massage apparatus described above.

From other than a performance standpoint, the design is also highly efficient in that the performance is achieved in a floating compact unit which is inherently safe, leak-free, and low maintenance. A positive rotation of shaft 32 could not have been achieved without difficulty by providing a mechanical drive such as a pulley and belt arrangement operated by the pump motor 82. The drawbacks of this approach are many, including the fact that a high ratio is required between the rotational speed of the motor 82 and the rotational speed of shaft 32, and, that a shaft seal which is water tight must be employed at the pulley end of the shaft. In addition, such a drive could not easily be adapted to the floating pulsator approach which is employed to enhance mechanical vibration at the flexible mat's stream. The present invention, on the other hand, avoids these problems by providing a self-contained unit having an integral drive mechanism which rotates independently of the shaft speed of the motor 82 by deriving its motive force from the water flow only. Since the motive force is applied internally, the need for shaft seals is eliminated and the use of water bearing is made possible. Furthermore, a low vibration frequency can be attained by adjustment of the volute and runner geometry and water flow rate, without regard for the fixed speed of the motor 82.

The air inlet assembly is preferably made as shown in FIG. 8 although any flow regulating valve, such as butterfly or sliding plate type valves may be utilized. The design shown employs two concentric cylinders 55 free to rotate with respect to one another, both cylinders having matching hole patterns in their sidewalls. The outer cylinder 62 is fitted with a cap 63 so that it forms a closed pipe. Alignment of the hole pattern by rotating the cylinders allows maximum air flow. Complete misalignment obstructs air flow completely. Intermediate control can be achieved by adjusting the valve to partially open positions. The advantage of the present valve lies in its ease of adjustment, the compactness and low cost of the assembly, and its tendency to stay in the desired position without requiring additional clamping fixtures to prevent rotation of the outer cylinder.

An auxiliary outlet 56, provides a source of turbulent water for a hand-held massage apparatus as described above. If it is desired to operate without the hand-held unit connected, a blocking cap 64 may be fitted as shown.

As described above, the mechanical vibrations produced by the pulsator may be used to increase the massage effect at the large flexible mat 11, by directly transmitting the vibrations to the mat's backing enclosure 12. The need for further vibration enhancement is met by providing eccentric weighting of the impellers 33 and 52, and the rotor 36 affixed to the shaft 32. Vibrations at the shaft rotation frequency are thereby produced and may be coupled directly into the enclosure 12, by means of the pulsator output flange 53.

Freedom of movement is essential if maximum vibration amplitude is desired, therefore the inlet pipe 57 should be flexible and should be provided with a strain relief loop. Freedom of movement is less easily achieved in a device which employs direct mechanical drives, once again illustrating the advantage of having a self-contained unit operated by water flow.

While a preferred embodiment of the present invention has been described, it should be realized that departure may be made from the particulars heretofore set forth without departing from the spirit of the invention. Among variants which may be practiced in accordance with the teachings and claims of the invention, several which are thought to have commercial importance are described below.

In combination with the massage apparatus, both the hand-held and fixed type, it is possible to produce the desired turbulence and aeration by injection of compressed air into a simple recirculation system which does not include the pulsator described herein.

An independent use may be made of the pulsator as the source for a spray-type massage which showers the user's body with packets of water/air mixture at fairly high velocities.

The flexible mats may be rendered in larger or smaller scale to accommodate larger or smaller water-/air mixture flow rates. Similarly, the scale of the pulsator may be altered to achieve the best adaptation to a particular flow-rate requirement.

In combination with the massage and hydro-therapy bath described above, various auxiliary devices such as steam generators, sun or heat lamps, water heaters, exhaust fans and appropriate controls may be employed to afford a completely controlled environment in which it is possible to sun-bathe, sauna, steam-bathe, or any appropriate combination of any, plus enjoy the relaxing the therapeutic benefits of hydro-therapy and massage within a single enclosed space.

What is claimed is:

1. An apparatus for operating on a high pressure water stream for producing a highly turbulent water flow comprising:

a. a generally cylindrical housing having at one end a volute through the inlet of which a water stream may enter, and having an outlet at the other end;

b. a rotatable shaft extending through the housing and mounted at approximately the center line of the housing;

c. an impeller affixed to the shaft at the volute end of the housing and cooperating with the volute for turning the shaft under the urging of the water stream entering through the volute inlet;

d. a rotor cylinder having a cylindrical body slightly smaller in diameter than the diameter of the housing, mounted on the rotatable shaft between the volute impeller and the output end and having a plurality of bores generally parallel to the shaft and spaced uniformly around the cylindrical body.

e. a plate mounted to the housing in a fixed position perpendicular to the rotatable shaft, immediately adjacent to the rotor cylinder and having a hole pattern which matches that of the output end of the rotor cylinder.

2. The apparatus of claim 1 wherein the housing has a second inlet which communicates with surrounding air for introducing air into the water stream and wherein the plate is a plurality of plates, the first of which is mounted immediately adjacent to the output end of the rotor cylinder and has a hole pattern which matches that of the output end of the rotor cylinder and whose circumference contacts the inner diameter of the housing, the remainder of which plates are spaced apart from one another and from the first plate and are mounted between the first plate and the output end of the housing in the vicinity of the air inlet so that the spaces between the plates communicate with the air inlet, all plates having hole patterns the center lines of which are in alignment with one another.

3. The apparatus of claim 2 wherein the holes in the plate closest to the output are fitted with flutter check valves.

4. The apparatus of claim 3, wherein a suction fan is fitted to the rotatable shaft adjacent to the plate closest to the output end of the housing for exhausting the water/air mixture.

5. The apparatus of claim 4 wherein the rotor cylinder, the suction fan and the impeller are eccentrically weighted for deliberately producing high amplitude mechanical vibration.

6. The apparatus of claim 3 wherein the bores in the rotor cylinder have gradually decreasing diameters from inlet end to outlet end, and wherein the diameters of the holes in the plates progressively increase from the first inlet side plate to the last outlet side plate for forming a venturi tube when the rotor cylinder bores and the holes in the plates are in alignment thereby enhancing air entrapment within the water stream.

7. A hydro-therapy and massage apparatus comprising:

a. a flexible mat having a plurality of protruding members spaced over one surface and having a plurality of of apertures spaced over its area;

b. a rigid enclosure having an inlet port, at least one side of which contains an opening the edges of which are adapted to receive and are attached to the edges of the flexible mat;

c. a generally cylindrical housing having at one end a volute through the inlet of which a water stream may enter, having a second inlet communicating with the surrounding air, and having an outlet at the other end adapted to mount to and mounted to the inlet port of the rigid enclosure;

d. a rotatable shaft extending through the housing and mounted at approximately the center line of the housing;

e. an eccentrically weighted impeller affixed to the shaft at the volute end of the housing and cooperating with the volute for turning the shaft under the urging of the water stream entering through the volute inlet;

f. an eccentrically weighted rotor cylinder having a cylindrical body slightly smaller in diameter than the diameter of the housing, mounted on the rotatable shaft between the volute impeller and the output end of the housing and having a plurality of bores generally parallel to the shaft and spaced uniformly around the cylindrical body;

g. a plurality of plates, the first of which is mounted immediately adjacent to the output end of the rotor cylinder and has a hole pattern which matches that of the output end of the rotor cylinder and whose circumference contacts the inner diameter of the housing, the remainder of which plates are spaced apart from one another and from the first plate and are mounted between the first plate and the output end of the housing in the vicinity of the air inlet so that the spaces between the plates communicate with the air inlet, all plates having hole patterns the center lines of which are in alignment with one another.

h. an eccentrically weighted suction fan affixed to the rotatable shaft adjacent to the plate closest to the output end of the housing, for exhausting the water/air mixture.

8. A hydro-therapy and massage apparatus comprising:

a. an enclosure having an inlet port and having at least one side which contains an opening the edges of which are adapted to receive and are attached to the edges of a flexible mat;

b. means for producing a turbulent water stream;

c. means for conveying turbulent water through the inlet port and into the interior of the enclosure;

d. a flexible, elastic mat attached to the edges of the enclosure opening, said mat having a plurality of protruding members spaced over one surface and having a plurality of apertures spaced over its area, said mat having sufficient elasticity to distend and relax in response to pressure variations produced by the turbulent water stream, said protruding members having sufficient length and rigidity as to cause the tips of said protruding members to move away from one another as the mat distends and to move toward one another as the mat relaxes.

9. The apparatus of claim 8 wherein the dimensions of the enclosure are sufficiently large that the resistance to water flow offered by the enclosure is low in comparison to the resistance to water flow offered by the apertures of the flexible mat.

10. The apparatus of claim 8 wherein the protruding members are composed of the same material as that of the flexible mat.

11. The apparatus of claim 8 wherein the flexible mat and the protruding members are integrally molded.

12. A hydro-therapy and massage apparatus comprising:

a. a flexible mat having a plurality of protruding members spaced over one surface and having a plurality of apertures spaced over its area;

b. an enclosure having an inlet port, at least one side of which contains an opening the edges of which are adapted to receive and are attached to the edges of the flexible mat;

c. means for producing a turbulent water stream by entrainment of air in a water stream; and, d. means for conveying turbulent water through the inlet port and into the interior of the enclosure.

13. The apparatus of claim 12 wherein the means for producing a turbulent water stream is means for rapidly in alternation interrupting and reinstating water flow.

14. The apparatus of claim 12 wherein the means for producing a turbulent water stream is means for entrainment of air in a water stream and, rapidly, in alternation, interrupting and reinstating water flow.

* * * * *